US009971301B2

(12) United States Patent
Iguchi et al.

(10) Patent No.: US 9,971,301 B2
(45) Date of Patent: May 15, 2018

(54) IMAGE PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Ken Iguchi, Numazu Shizuoka (JP); Kikuo Mizutani, Izu Shizuoka (JP); Yuichi Saito, Numazu Shizuoka (JP); Yoici Yamaguchi, Gotenba Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/219,550

(22) Filed: Jul. 26, 2016

(65) Prior Publication Data

US 2017/0168451 A1 Jun. 15, 2017

(30) Foreign Application Priority Data

Dec. 9, 2015 (JP) ..... 2015-240057

(51) Int. Cl.
*G03G 21/20* (2006.01)
*G03G 15/00* (2006.01)

(52) U.S. Cl.
CPC ..... *G03G 21/206* (2013.01); *G03G 15/6511* (2013.01); *G03G 2215/004* (2013.01);
(Continued)

(58) Field of Classification Search
CPC ..... G03G 21/20; G03G 21/206; G03G 15/65; G03G 15/6502; G03G 15/6511;
(Continued)

(56) References Cited

U.S. PATENT DOCUMENTS 4,379,549 A * 4/1983 Mizuma ..... B65H 1/04 271/163
5,100,022 A * 3/1992 Fukudome ..... B65H 1/02 221/198

(Continued)

FOREIGN PATENT DOCUMENTS

JP 2007-034127 2/2007

*Primary Examiner* — David Banh
(74) *Attorney, Agent, or Firm* — Amin, Turocy & Watson LLP; Gregory Turocy

(57) ABSTRACT

An image processing apparatus comprises a container mounted on a side wall of the image processing apparatus and comprising a bottom extending upwards in the vertical direction at a predetermined angle from the side wall for supporting an end of a sheet and a wall member vertically arranged on the bottom and forming a space with the bottom, and configured to house a sheet in the space through an opening formed on the upper side of the container; and a pickup unit located adjacent to the bottom of the container and having a pickup roller and configured to move the pickup roller to the inside of the container if a pickup operation for conveying the sheet to the inside of the image processing apparatus is executed, and keep the pickup roller at a waiting position outside of the space of the container if the pickup operation is not executed.

12 Claims, 10 Drawing Sheets

(52) U.S. Cl.
CPC ..... *G03G 2215/00392* (2013.01); *G03G 2215/00396* (2013.01); *G03G 2215/0132* (2013.01)

(58) Field of Classification Search
CPC ..... G03G 2215/00392; G03G 2215/00396; G03G 2215/004; G03G 2215/0132; B65H 1/02
See application file for complete search history.

(56) References Cited

U.S. PATENT DOCUMENTS

| | | | | |
|---|---|---|---|---|
| 5,732,309 | A * | 3/1998 | Okuno | G03G 15/2064 399/320 |
| 6,896,255 | B1 * | 5/2005 | Fick | G07D 11/0012 271/126 |
| 8,115,976 | B2 | 2/2012 | Murakami | |
| 8,848,239 | B2 | 9/2014 | Iguchi et al. | |
| 9,073,344 | B2 | 7/2015 | Kashiwagi | |
| 2005/0230898 | A1 * | 10/2005 | Suqiyama | B65H 9/106 270/58.08 |
| 2007/0104509 | A1 * | 5/2007 | Kabashima | G03G 15/6502 399/124 |
| 2010/0120338 | A1 | 5/2010 | Ono | |
| 2011/0125311 | A1 * | 5/2011 | Claghorn | B65H 1/02 700/213 |
| 2011/0199448 | A1 * | 8/2011 | Kaiho | B41J 11/002 347/102 |
| 2013/0119600 | A1 * | 5/2013 | Liao | B65H 3/0684 271/117 |
| 2016/0124350 | A1 * | 5/2016 | Tomoe | B65H 7/20 399/316 |

* cited by examiner

IMAGE PROCESSING APPARATUS

CROSS-REFERENCE TO RELATED APPLICATION

This application is based upon and claims the benefit of priority from Japanese Patent Application No. 2015-240057, filed Dec. 9, 2015, the entire contents of which are incorporated herein by reference.

FIELD

Embodiments described herein relate generally to an image processing apparatus including a function of forming an image on a sheet and a function of decoloring the image formed on the sheet.

BACKGROUND

In recent years, an image decoloring apparatus is known which sequentially conveys a sheet on the surface of which an image is formed with a coloring agent that can be decolored through heating at a predetermined temperature and carries out a decoloring processing by pressuring and heating. Further, an image processing apparatus which includes a function of forming an image on a sheet and a function of decoloring the image formed on the sheet is also known.

In such an image processing apparatus, for example, if a user wants to decolor a sheet, the user houses the sheet in a cassette.

DETAILED DESCRIPTION

Figure 1:
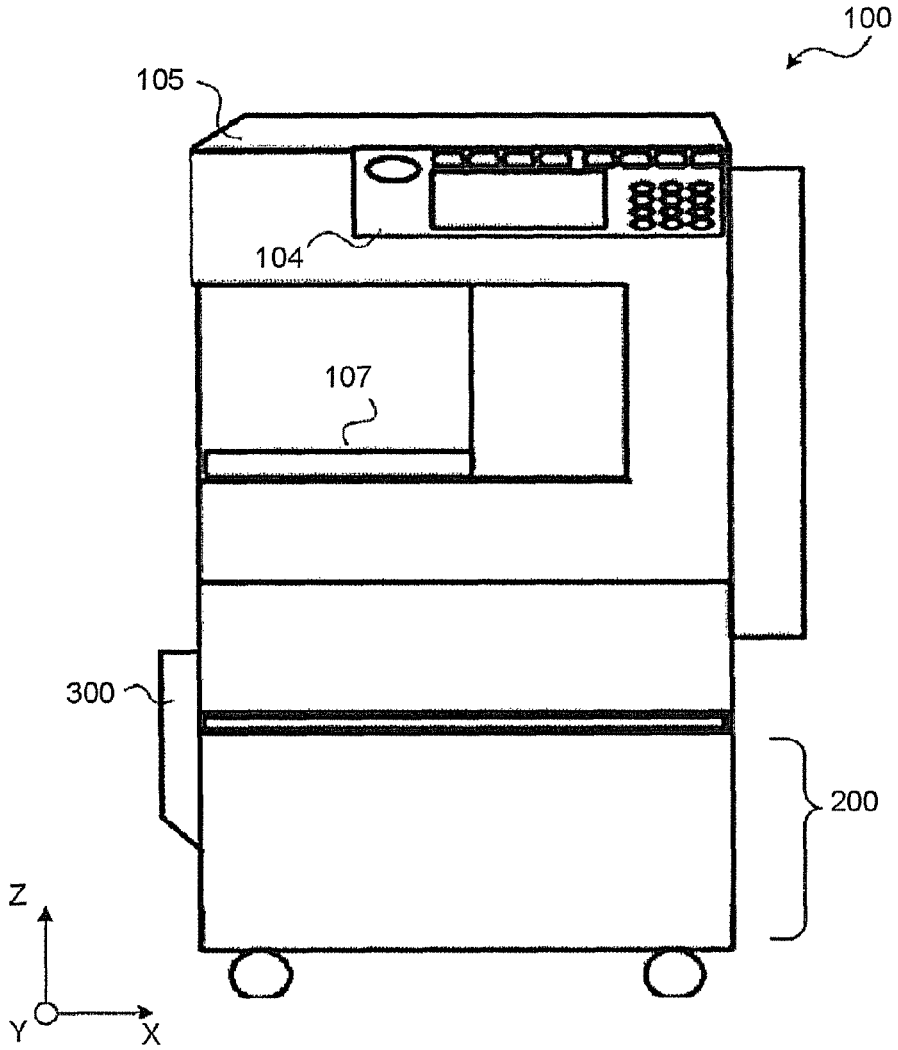
FIG. 1 is a diagram illustrating the appearance of an image processing apparatus according to an embodiment.

In accordance with an embodiment, an image processing apparatus comprises a container mounted on a side wall of the image processing apparatus and comprising a bottom extending upwards in the vertical direction at a predetermined angle from the side wall for supporting an end of a sheet and a wall member vertically arranged on the bottom and forming a space with the bottom, and configured to house a sheet in the space through an opening formed on the upper side of the container; and a pickup unit located adjacent to the bottom of the container and having a pickup roller and configured to move the pickup roller to the inside of the container if a pickup operation for conveying the sheet to the inside of the image processing apparatus is executed, and keep the pickup roller at a waiting position outside of the space of the container if the pickup operation is not executed.

The image processing apparatus of the embodiment is able to carry out both a decoloring process and an image forming process and can also form an image on a sheet to which the decoloring process is carried out as it is. While the image processing apparatus of the embodiment does not execute a printing process or a copy process, if there is a sheet that should be decolored, the image processing apparatus carries out the decoloring process on the sheet.

Further, the image processing apparatus of the embodiment can carry out both a printing operation with a decolorable color material and a printing operation with a non-decolorable color material. The decolorable color material is fixed on a sheet at a regulated fixing temperature and further decolored if heated at a decoloring temperature higher than the fixing temperature. The decolorable color material contains a color generation compound, a developer and a decoloring agent. As the color generation compound, for example, leuco dyes are exemplified. As the developer, for example, phenols are exemplified. As the decoloring agent, a substance which is blended with the color generation compound if heated and does not have affinity to the developer is exemplified. The decolorable color material develops the color through interaction of the color generation compound and the developer, and can be decolored as the interaction of the color generation compound and the developer is cut off through the heating at a temperature equal to or higher than the decoloring temperature.

In the embodiment, toner is exemplified as the color material; however, there may be a case in which the image forming processing is carried out by using ink. The "decoloring" according to the present embodiment refers to a process of making an image formed with a color (containing not only chromatic colors but also achromatic colors such as white, black and the like) different from a base color of the sheet invisible visually. The "invisible visually" may be a form in which the image formed with the color different from the base color of the sheet is changed to a color identical or similar to the base color of the sheet in addition to a form in which the image formed with the color different from the base color of the sheet is colorless (transparent).

The image processing apparatus of the embodiment includes a non-decolored sheet cassette for housing a non-decolored sheet serving as a used sheet, a decolored sheet cassette for housing a sheet to which the decoloring processing is carried out through the heating and a normal cassette for housing a new sheet. Further, the image processing apparatus of the embodiment includes a pocket-like sheet feed section of which the upper part is opened on a side wall of the outside of a housing. A user throws a sheet to be processed into an opening section to complete the set to the sheet feed section. The pocket-like sheet feed section is called a side sheet feed section. The side sheet feed section vertically houses the sheet to be processed (non-decolored sheet in the embodiment).

In accordance with another embodiment, an image processing method involves housing a sheet to be processed in a space of a container mounted on a side wall of an image processing apparatus through an opening formed on the upper side of the container, the container having a bottom extending upwards in the vertical direction at a predetermined angle from the side wall for supporting an end of the sheet and a wall member vertically arranged on the bottom and forming the space with the bottom; moving a pickup roller located adjacent to the bottom of the container into the inside of the container if a pickup operation for conveying the sheet to be processed to the inside of the image processing apparatus is executed; and keeping the pickup roller at a waiting position outside of the space of the container if the pickup operation is not executed.

Hereinafter, each embodiment is described with reference to the accompanying drawings.

First Embodiment

Figure 2:
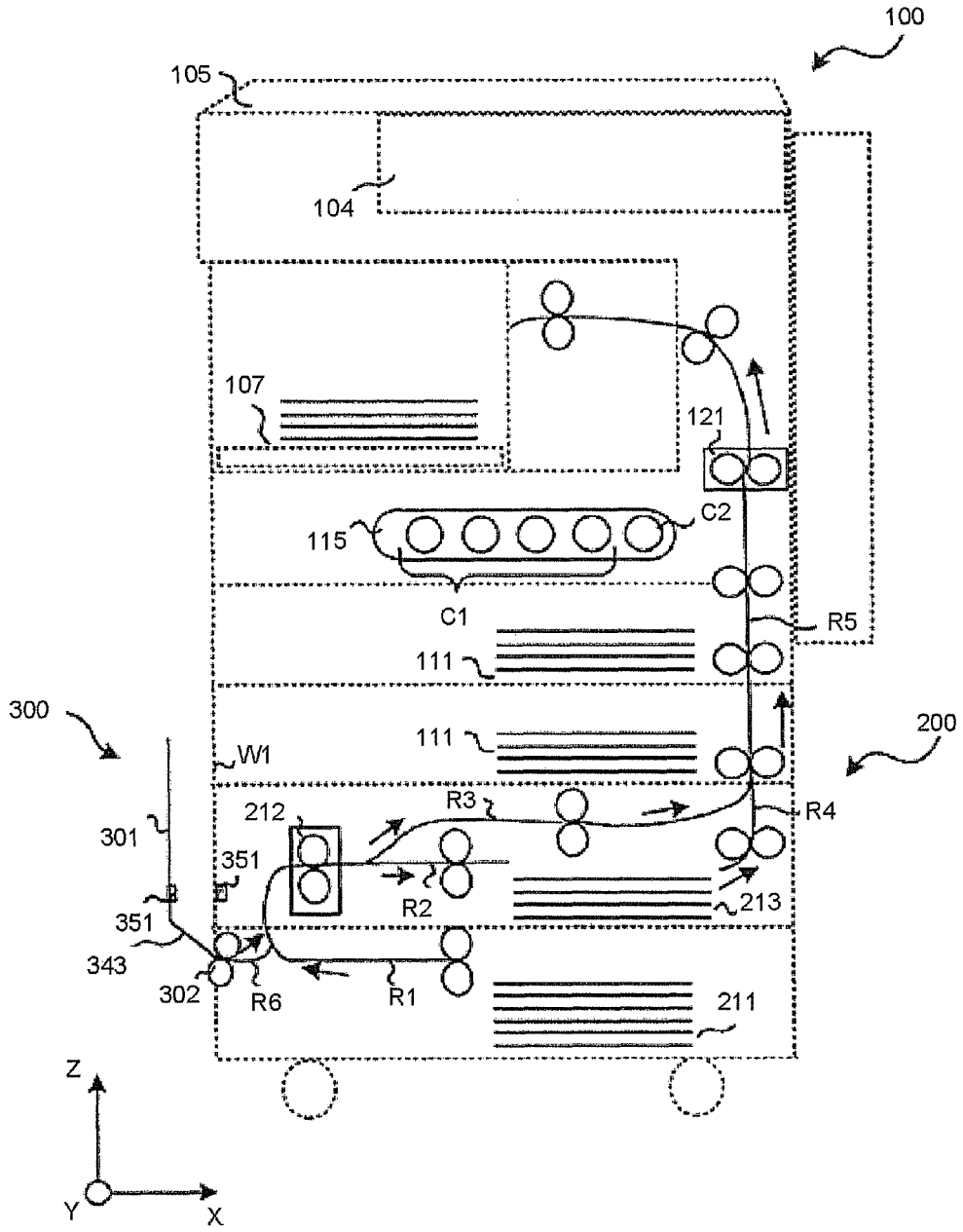
FIG. 2 is a schematic view illustrating an example of the inner configuration of the image processing apparatus according to the embodiment.

FIG. 1 illustrates an image processing apparatus according to the embodiment, and FIG. 2 illustrates a schematic view of the configuration of the image processing apparatus. X axis, Y axis and Z axis in FIG. 1 and FIG. 2 are common in each figure. Further, an arrow in FIG. 2 indicates a conveyance direction of a sheet.

An image processing apparatus 100 shown in FIG. 2 includes a normal cassette 111 for housing a new sheet or a sheet that is being used but at least one surface of which is unused. The image processing apparatus 100 includes an image forming section 115 for forming an image on a sheet and a discharge tray 107 for placing the sheet after the image formation. The image forming section 115 includes a cartridge C1 for housing the non-decolorable color material serving as a normal color material and a cartridge C2 for housing the decolorable color material to be decolored at the temperature equal to or higher than the decoloring temperature. The image processing apparatus 100 further includes a heating device 121 for heating and pressuring the sheet on which the image is formed to fix the image on the sheet.

The image processing apparatus 100 includes a conveyance path R5 for conveying the sheet to the normal cassette 111, the image forming section 115 and the discharge tray 107 in order. The image processing apparatus 100 includes an operation panel 104 for receiving the input of a parameter value such as the printing number of copies and an instruction of starting a processing from the user and displaying the state of progress of a job. The image processing apparatus 100 includes a reading section 105 for reading a document sheet. An image read by the reading section 105 is output to the image forming section 115, and the image forming section 115 forms the image on a sheet (copy processing).

The image processing apparatus 100 includes an image decoloring apparatus 200 in the lower portion of a main body section. The image decoloring apparatus 200 can be mounted in the main body section of the image processing apparatus 100 as an option, or provided as a simple substance.

The image decoloring apparatus 200 includes a non-decolored sheet cassette 211, a decoloring section 212 and a decolored sheet cassette 213. The non-decolored sheet cassette 211 houses a sheet having an image drawn with the color material to be decolored at the regulated or higher decoloring temperature. The decolored sheet cassette 213 houses the sheet on which the color material image is decolored by the decoloring section 212 through the heating to be reused later. The decoloring section 212 heats the sheet supplied from the non-decolored sheet cassette 211 at the temperature equal to or higher than the decoloring temperature using a heat source of the decoloring section 212. In this way, the decoloring section 212 decolors the color material on the sheet to decolor the drawn color material image. The decolored sheet cassette 213 loads and houses the sheet to which the decoloring processing is carried out by the decoloring section 212.

The image decoloring apparatus 200 includes a conveyance path R1 for conveying the sheet from the non-decolored sheet cassette 211 to the decoloring section 212 and a conveyance path R2 for conveying the sheet from the decoloring section 212 to the decolored sheet cassette 213.

The image decoloring apparatus 200 further includes a conveyance path R4 one end of which is connected with the conveyance path. R5 located in the main body section of the image processing apparatus 100 and the other end of which is connected with the decolored sheet cassette 213. If the image decoloring apparatus 200 is mounted in the main body section of the image processing apparatus 100 as the option, the conveyance path R4 is connected with the conveyance path R5 to be capable of supplying the sheet housed in the decolored sheet cassette 213 to the inside of the main body section. In this way, the image processing apparatus 100 can carry out the image formation even on the sheet housed in the decolored sheet cassette 213 with the image forming section 115 and discharge the sheet to the discharge tray 107 via the conveyance paths R4 and R5.

The image decoloring apparatus 200 includes a conveyance path R3 that branches from the conveyance path R2 and is connected with the conveyance path R5 at the downstream position of the decoloring section 212. Through the conveyance path R3, the sheet to which the decoloring processing is carried out by the decoloring section 212 is immediately conveyed to the image forming section 115 without being housed in the decolored sheet cassette 213 to be subjected to the image forming processing. Through the configuration, in a case in which there is no sheet in the decolored sheet cassette 213, the image processing apparatus 100 supplies the sheet from the non-decolored sheet cassette 211 to the decoloring section 212 and then conveys the sheet passing the decoloring section 212 to the image forming section 115 as it is.

In this way, the image processing apparatus 100 is integrally mounted with the image decoloring apparatus 200 to be capable of executing a series of operations including decoloring the image with the decoloring section 212 and carrying out the image formation on the decolored sheet with the image forming section 115.

The image processing apparatus 100 of the embodiment can mount a side sheet feed section 300 on a side wall W1 thereof. The side sheet feed section 300 may be provided as an option (a simple substance) or integrally mounted with the image processing apparatus 100 or the image decoloring apparatus 200. The side sheet feed section 300 includes a contour section 301 and a sensor 351. A pickup section 302 may be included in the image decoloring apparatus 200 or the side sheet feed section 300. The contour section 301 is constituted by a bottom 343 and a side wall section vertically arranged on the bottom 343. The sheet is housed in a space formed by the side wall W1 of the image processing apparatus 100 and the side wall section of the contour section 301. The bottom 343 supports an end of the sheet. The contour section 301 is formed into a shape in which the length in the height direction (herein, Z axis direction) is at least longer than that in the horizontal direction (herein, X axis direction); however, it is not limited to this. The contour section 301 may be a shape in which the length in the Y axis direction is longer than that in the X axis direction. Further, for the relation between the length in the Y axis direction and the length in the Z axis direction, whether the sheet is housed in such a manner that the longitudinal direction of the sheet is the Z axis direction or the Y axis direction depends on the shape or area of the side wall W1. The contour section 301 may house the whole sheet or house the sheet in a state of exposing a part of the sheet if the size of the sheet is large.

If the side sheet feed section 300 is mounted, the bottom 343 of the contour section 301 is connected with a conveyance path R6. Through the configuration, the sheet housed in the side sheet feed section 300 is picked up by the pickup section 302 and supplied to the inside of the main body section through the conveyance path R6. The conveyance path R6 is merged with the conveyance path R1 at the upstream side of the decoloring section 212 as shown in FIG. 2. Thus, the sheet conveyed by the conveyance path R6 passes the conveyance path R1 and is subjected to the decoloring processing by the decoloring section 212.

The contour section 301 serves as a contour for housing the sheet and serves as a container section for housing the sheet together with the side wall W1 of the image processing apparatus 100. The side sheet feed section 300 shown in FIG. 2 does not have the contour wall on the side wall W1 of the image processing apparatus 100; however, it may have the contour wall (contour wall opposite to the contour section 301) contacting with the side wall W1.

The upper part of the contour section 301 is opened, and the user vertically throws the sheet to be decolored into the side sheet feed section 300 through the opening section. The bottom 343 of the contour section 301 is inclined and extends upwards in the vertical direction at a predetermined angle from the side wall W1. The predetermined angle may be at least increased with the bottom 343 extending towards the outer side of the image processing apparatus 100 or decreased with the bottom 343 extending towards the side wall W1 of the image processing apparatus 100. In the present embodiment, the angle of the bottom 343 with respect to the horizontal direction is about 30-50 degrees; however, it is not limited to this. By inclining the bottom 343 in this way, the sheet supported by the bottom 343 slides towards the side wall W1 of the image processing apparatus 100 due to gravity.

Further, the side wall section of the contour section 301 may be arranged in such a way as to be vertical (90 degrees) to the X-Y plane in the example shown in FIG. 2; however, the side wall section may be inclined to widen the opening area of the upper part so as to make the sheet easy to be thrown into the contour section 301. The inclination angle is allowed within a range from 45 degrees to 90 degrees with respect to the X-Y plane; however, it is not limited to this. In a security relationship, the side wall section of the contour section 301 may be inclined in such a manner that the opening area of the upper part is narrowed.

The sensor 351 detects whether or not there is a sheet housed in the side sheet feed section 300 and outputs a detection signal to a control section described later. The sensor 351 is constituted as, for example, an infrared light-emitting device and a light receiving device. If there is no sheet between the light receiving device and the light emitting device, an infrared ray from the light emitting device arrives at the light receiving device as it is; however, if the sheet is housed, the infrared ray from the light emitting device is shielded and does not arrive at the light receiving device. In the present embodiment, in a case in which the light receiving device receives the infrared ray, it is determined that the sheet is not housed, but in a case in which the light receiving device does not receive the infrared ray, it is determined that the sheet is housed.

Figure 3:
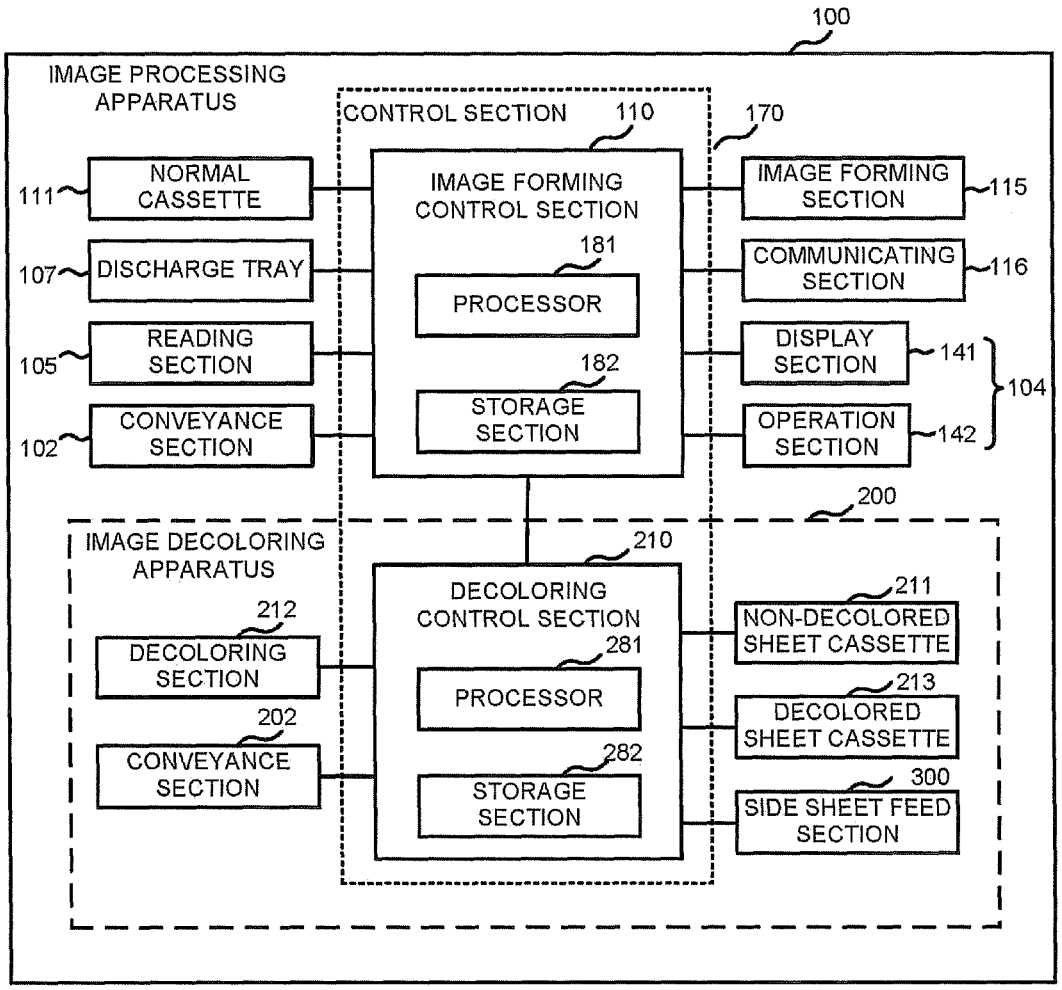
FIG. 3 is a block diagram illustrating an example of the configuration of the image processing apparatus according to the embodiment.

FIG. 3 illustrates a block diagram of the image processing apparatus 100 according to the embodiment. The image processing apparatus 100 includes an image forming control section 110 (controller) at least containing a processor 181 and a storage section 182. The processor 181 is an arithmetic processing apparatus such as a CPU (Central Processing Unit). The processor 181 executes programs stored in the storage section 182 to realize various functions. The storage section 182 includes a main storage device for storing data in a volatile manner and directly carrying out input and output of the data from and to the processor 181. The storage section 182 further includes a ROM or an auxiliary storage device for storing data and programs in a non-volatile manner. Through the configuration, the image forming control section 110 collectively controls the main body unit of the image processing apparatus 100.

The image processing apparatus 100 includes a communication section 116. The communication section 116 receives print job from a personal computer and replies a telegram relating to a processing result and a status to the personal computer serving as a sending source according to instructions of the image forming control section 110.

The normal cassette 111, the discharge tray 107 and the reading section 105 shown in FIG. 3 are described as stated above. The operation panel 104 includes a display section 141 serving as a flat-type liquid crystal monitor and an operation section 142 constituted by physical buttons and a touch panel laminated on the display section 141. The conveyance section 102 which includes the conveyance path R5 conveys the sheet to each unit according to the instructions of the image forming control section 110.

The image decoloring apparatus 200 includes a decoloring control section 210 (controller). The decoloring control section 210 collectively controls each unit in the image decoloring apparatus 200 and includes a processor 281 and a storage section 282. The processor 281 controls the inner unit of the image decoloring apparatus 200 according to data and program codes stored in the storage section 282. A part or all of the decoloring control section 210 may be installed in a circuit such as an ASIC (application specific integrated circuit). Furthermore, the functions of the decoloring control section 210 may be carried out by the image forming control section 110 of the image processing apparatus 100.

The non-decolored sheet cassette 211, the decolored sheet cassette 213, the decoloring section 212 and the side sheet feed section 300 in FIG. 3 are identical to the above. A conveyance section 202 which includes the conveyance paths R1, R2, R3, R4 and R6 conveys the sheet to each unit according to instructions of the decoloring control section 210.

A configuration containing the image forming control section 110 and the decoloring control section 210 is set to a control section 170 (controller). In other words, the control section 170 collectively controls all the units in the image processing apparatus 100 containing the image decoloring apparatus 200 and the side sheet feed section 300.

In the image decoloring apparatus 200, in a decoloring operation, if the non-decolored sheet cassette 211 is switched from a closed state to an opened state, it is possible that sheet jam occurs or the sheet is destroyed due to shearing generated between the cassette and the main body. Thus, in the decoloring operation, it is forbidden in principle that the non-decolored sheet cassette 211 is kept in the opened state. The forgoing situation is the same as that even in other cassette sections, and it is forbidden in principle that the cassette sections are kept in the opened state in the decoloring operation. On the other hand, by arranging the side sheet feed section 300, even in the decoloring operation, the user is possible to throw and set a sheet to be processed into the side sheet feed section 300.

The side sheet feed section 300 may be arranged in such a way as to be long in the height direction (Z axis direction). In this way, a setting area of the image processing apparatus 100 can be small.

By arranging the side sheet feed section 300, the user only need to carryout an operation of throwing a sheet to be processed into the side sheet feed section 300. In other words, the user does not need to do complex operations of switching the cassette to the opened state to set the sheet and closing the cassette at the time of setting the sheet to be processed in the image processing apparatus 100.

Through such a configuration, it is possible to set the sheet easily.

Second Embodiment

As the bottom of the side sheet feed section 300 of the first embodiment is inclined, the sheet in the side sheet feed section 300 can directly slide towards the side wall W1 of the image processing apparatus 100 due to the weight of the sheet itself. In other words, the sheet can move to a position at which the front end of the sheet is easy to be picked up by the pickup section 302. In the second embodiment, a form of easily picking up the front end of the sheet is described.

Figure 4:
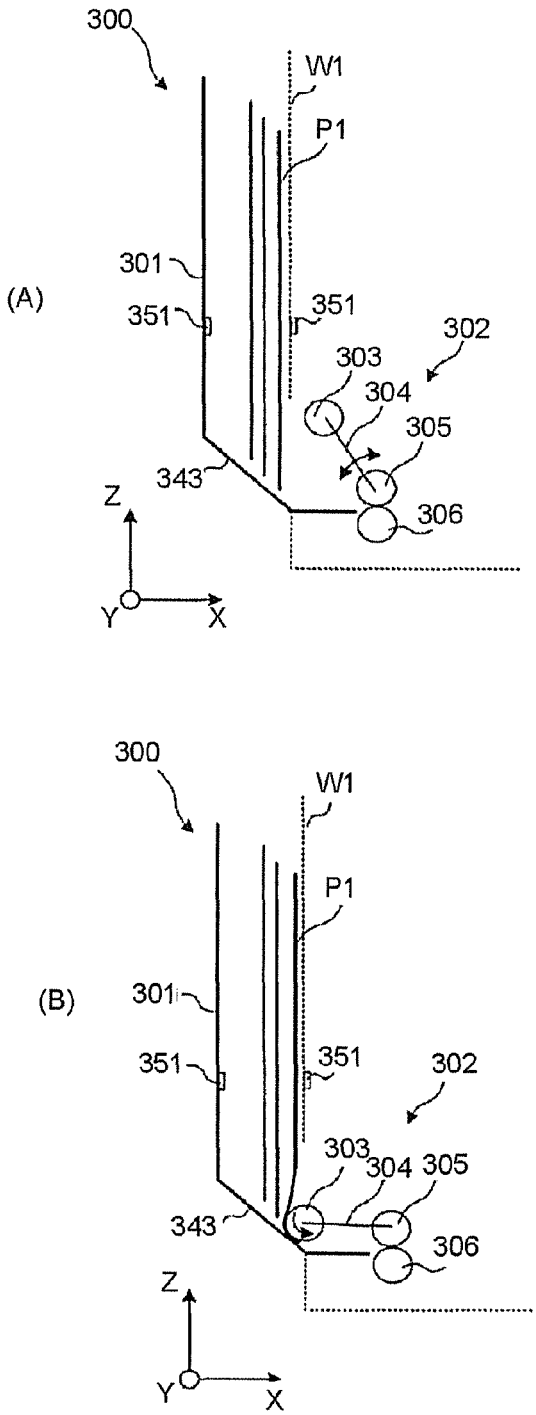
FIG. 4 is a diagram illustrating an example of the configuration of a pickup section according to a second embodiment.

FIG. 4 illustrates the pickup section 302 according to the second embodiment. The pickup section 302 includes a pickup roller 303, a roller pair 305 and 306 and an arm member 304.

The positions of the roller pair 305 and 306 are fixed, and a sheet P1 is conveyed to the inside of the main body of the image processing apparatus 100 with the roller pair 305 and 306 rotating. One end of the arm member 304 is a free end and is held on the pickup roller 303. The other end of the arm member 304 is located at the center part of the roller 305. The arm member 304 rotates by taking the center of the roller 305 as a fulcrum and enables the pickup roller 303 to move upwards or downwards centering on the roller 305.

FIG. 4(A) illustrates an evacuation state while a pickup operation is not carried out, and FIG. 4(B) illustrates a state at the time of executing the pickup operation. In the case of the evacuation state, the pickup roller 303 is kept at awaiting position inside the image processing apparatus 100 (refer to FIG. 4(A)). In other words, the pickup roller 303 stays at the waiting position outside of the container space if the pickup operation is not executed. As the pickup roller 303 is located inside the image processing apparatus 100, when the sheet is added to the side sheet feed section 300, the sheet can be housed without being disturbed by the pickup roller 303 (the sheet is not caught in the pickup roller 303).

At the time of the pickup operation, the pickup roller 303 counterclockwise rotates to a position for contacting with the sheet at a predetermined angle centering on the roller 305. At this time, a part of the pickup roller 303 enters to the inside of the side sheet feed section 300 (the outside of the image processing apparatus 100) and contacts with a front end portion of the sheet P1. The pickup roller 303 further counterclockwise rotates at a predetermined angle and sandwiches the lower front end portion of the sheet P1 with the bottom 343 (refer to FIG. 4(B)). If the pickup roller 303 rotates around an axis thereof in the arrow direction in the sandwiched state, the sheet P1 is conveyed to the direction of the roller pair 305 and 306. If the sheet P1 arrives at the roller pair 305 and 306 through the rotation of the pickup roller 303, the sheet P1 is conveyed to the inside of the main body of the image processing apparatus 100 through the rotation of the roller pair 305 and 306.

After one sheet is conveyed to the inside of the main body of the image processing apparatus 100, the pickup section 302 moves to the waiting position and is transited to the evacuation state shown in FIG. 4(A). In a case in which a next sheet further exists, the pickup section 302 becomes a pickup state shown in FIG. 4(B) to feed the next sheet to the inside of the main body. The states shown in FIG. 4(A) and FIG. 4(B) are repeated until there are no remaining sheets. While the pickup section 302 is located at a position shown in FIG. 4(B) in an abutting state, a next sheet may be fed.

The addition and the pickup of the sheet can be smoothly carried out through the pickup section 302 according to the second embodiment.

Third Embodiment

In the third embodiment, an implementation example of separating a sheet to be picked up from a bundle of sheets stored in the side sheet feed section 300 is described.

Figure 5:
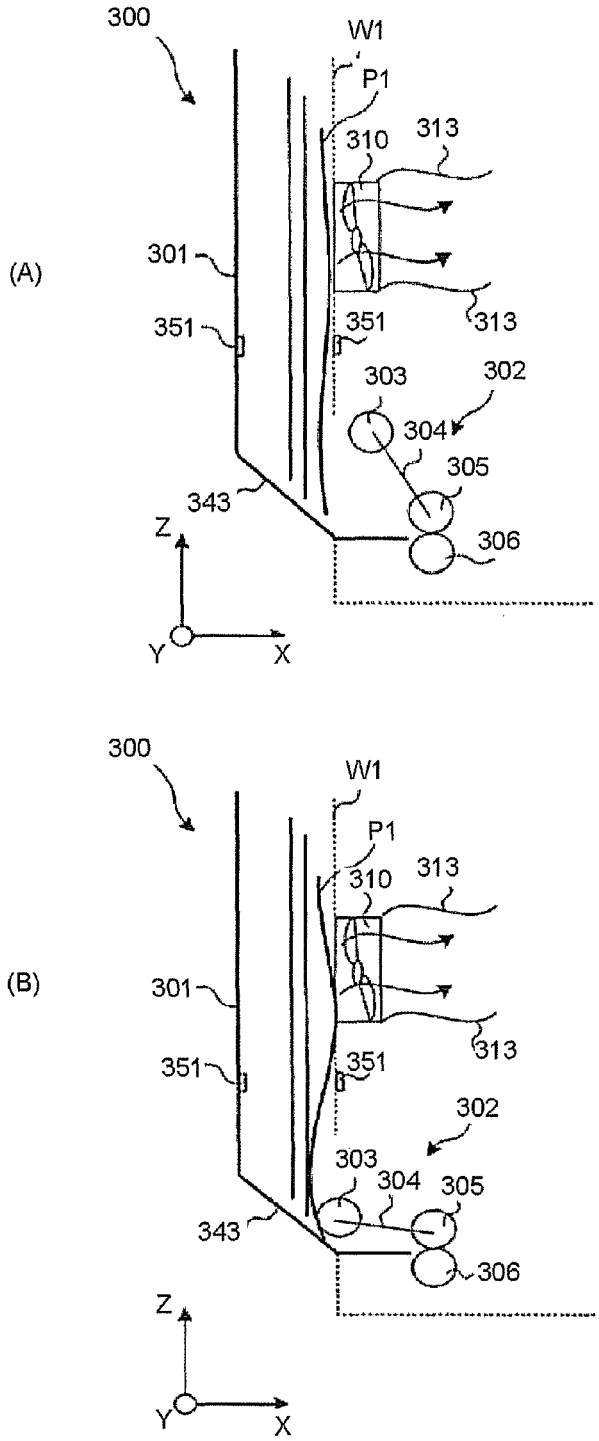
FIG. 5 is a diagram illustrating an example of the configuration of a fan according to a third embodiment.

FIG. 5 is a diagram illustrating an example of the form of the third embodiment. The image processing apparatus 100 of the third embodiment includes a fan 310 for blowing air from the inside of the side sheet feed section 300 to the inside of the image processing apparatus 100. The fan 310 also serves as an air intake device for cooling the inside of the image processing apparatus 100. The fan 310 may be diverted to a fan for cooling the inside of the image processing apparatus 100 (for example, a cooling fan of the decoloring section 212). Further, as shown in FIG. 5, the side sheet feed section 300 may include a duct 313 for guiding air intake from the fan 310 to a specific unit inside the image processing apparatus 100 (for example, the decoloring section 212).

At the time of the pickup operation, in the third embodiment, as shown in FIG. 5(A), firstly, the fan 310 is operated. In this way, the sheet located at the side of the side wall of the image processing apparatus 100, that is, the sheet P1 to be picked up this time is adsorbed on the side wall of the image processing apparatus 100 in a side adsorption manner to be separated from the bundle of the sheets. Further, the quantity of the rotation of the fan 310 and the size of the diameter of the fan 310 are designed to a degree to which the sheet located at the side of the side wall of the image processing apparatus 100 moves.

After the fan 310 is operated, the pickup section 302 picks up the sheet (refer to FIG. 5(B)). In this way, it is suppressed that a plurality of sheets is simultaneously picked up, and it is possible to assist one sheet located nearby the side wall W of the image processing apparatus 100 in being picked up.

Figure 6:
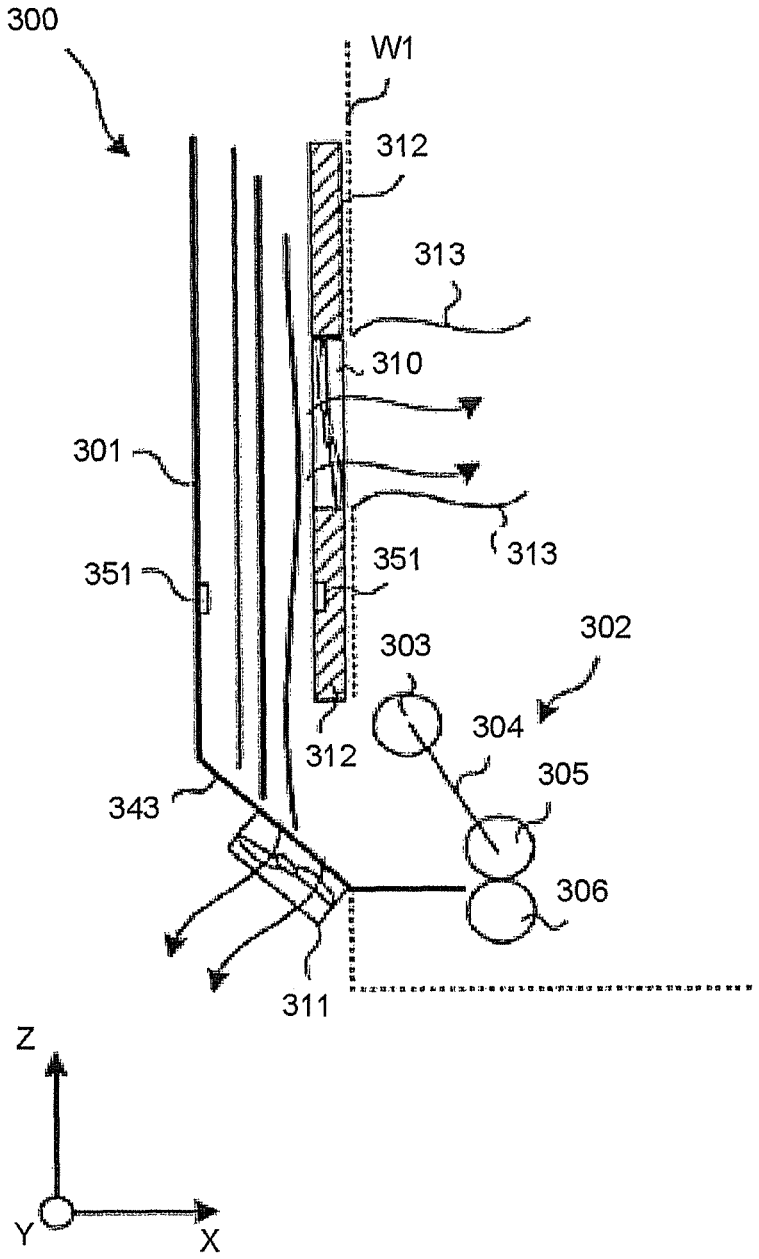
FIG. 6 is a diagram illustrating an example of the configuration in a case of including an auxiliary fan.

In the foregoing embodiment, an implementation example of arranging the fan 310 at the side of the image processing apparatus 100 is described; however, the fan 310 may be arranged at the side of the side sheet feed section 300. In other words, as shown in FIG. 6, regarding the contour section 301 of the side sheet feed section 300, the fan 310 may be incorporated into a wall 312 contacting with the side wall W1 of the image processing apparatus 100. Further, the sensor 351 may be incorporated in the wall 312. Furthermore, an auxiliary fan 311 may be arranged in the bottom 343 to guide the sheet housed in the side sheet feed section 300 more downwards. The auxiliary fan 311 rotates in a direction in which the auxiliary fan 311 exhausts the air inside the side sheet feed section 300.

Through such a configuration, even for a sheet housed in the side sheet feed section 300, it is possible to smoothly separate the sheet and pick up it to feed it.

Fourth Embodiment

In each of the foregoing embodiments, the upper part of the side sheet feed section 300 is a state of being always opened. In this case, there is a possibility that a foreign substance such as rubbish falls in the inside of the side sheet feed section 300. Furthermore, since it is possible that a third party recognizes the sheet housed inside the side sheet feed section 300 visually, there is a problem even in a security point of view.

In the fourth embodiment, an implementation example of arranging a lip on the upper part of the side sheet feed section 300 is described. In this way, the foreign substance is suppressed from being mixed, and it is suppressed that the third party recognizes the inside sheet visually.

Figure 7:
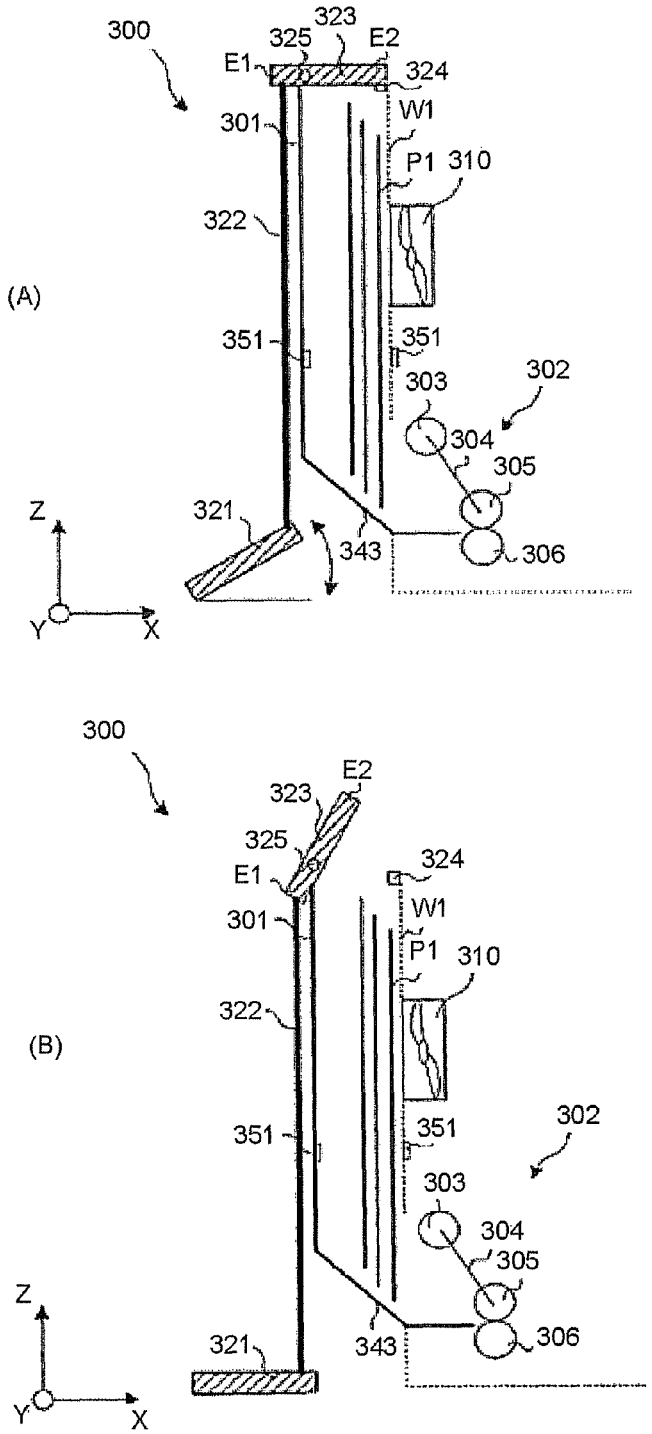
FIG. 7 is a diagram illustrating an example of the configuration in a case of including a lid section and an opening and closing mechanism of the lid section according to a fourth embodiment.

FIG. 7 is a diagram illustrating the form of the fourth embodiment. The side sheet feed section 300 of the fourth embodiment includes a lid section 323 on the upper part of the contour section 301 as shown in FIG. 7(A). The lid section 323 covers the opening of the space of the container. The lid section 323 is a state of opening or closing the upper part of the contour section 301. Further, from the security point of view, the lid section 323 may be locked. Whether the lid section 323 is in an opened state or a closed state is detected by an opening and closing detection switch 324, and a detection signal is output to the control section 170.

The side sheet feed section 300 includes a pedal 321. One front end part of the pedal 321 is bonded with a transmission member 322, and the other end thereof is a rotational axis of the pedal 321. The transmission member 322 which is, for example, a string-like member is bonded with an end part E1 of the lid section 323.

If a load is applied by stepping on the pedal 321 by foot, the end part of the pedal 321 moves (rotates) downwards, the transmission member 322 falls downwards and thus the end part E1 of the lid section 323 also falls. As an axis 325 of the lid section 323 is a rotational fulcrum, if the end part E1 falls, and an end part E2 serving as a point of action rises, and the lid section 323 is in the opened state (refer to FIG. 7(B)).

If the load of the pedal 321 is released, the end part of the pedal 321 moves (rotates) upwards, the transmission member 322 rises to raise the end part E1 of the lid section 323, and the end part E2 falls. In this way, the lid section 323 is in the closed state (refer to FIG. 7(A)).

Figure 8:
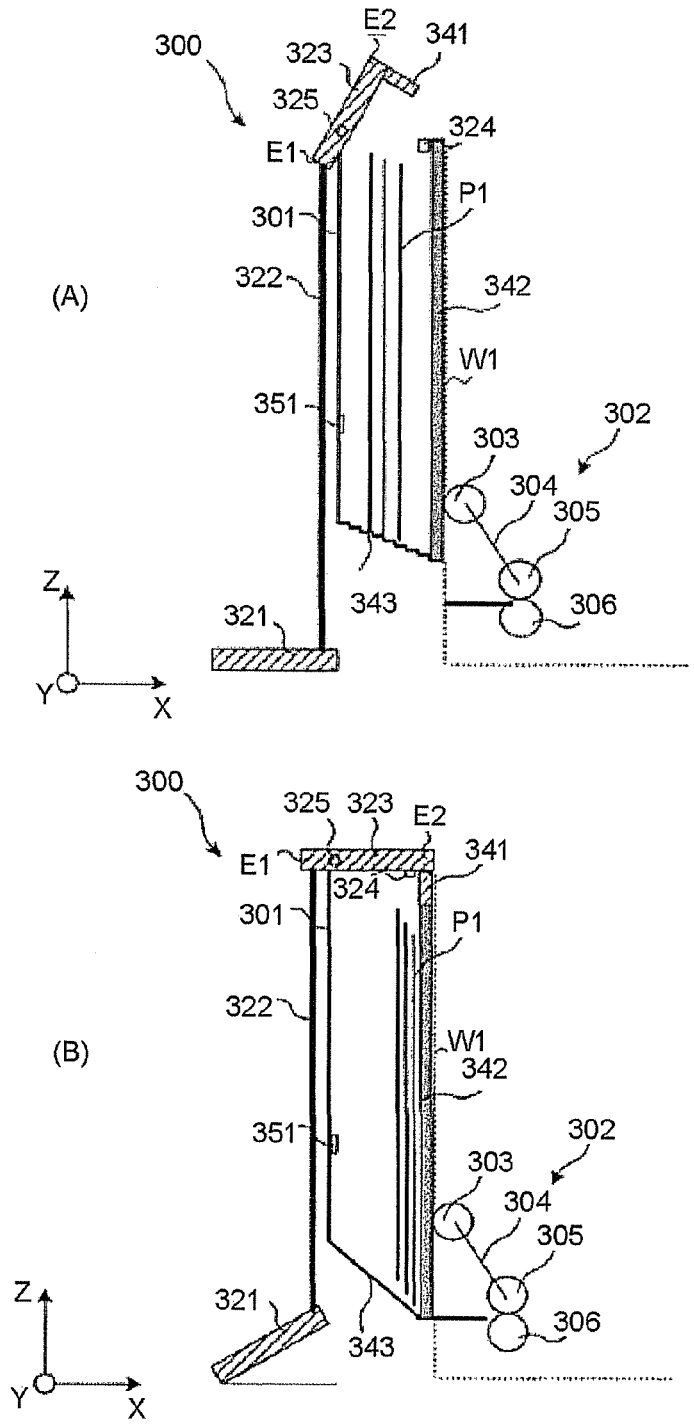
FIG. 8 is a diagram illustrating an example of the configuration in a case of including a bottom slope changing mechanism according to the fourth embodiment.

Through the opening and closing of the lid section 323, there may be an implementation example in which an inclined angle of the bottom 343 may be changed. The implementation example is illustrated in FIG. 8. In FIG. 8, the illustration of a part of mechanisms is omitted.

As shown in FIG. 8(A), a protrusion section 341 is arranged below the end part E2 of the lid section 323, and a slide member 342 capable of moving in the vertical direction is arranged on the side wall of the side sheet feed section 300 facing the image processing apparatus 100. The slide member 342 is energized upwards through a spring (not shown). The bottom 343 is a staircase shape or a bellows shape and stretchable. A stretchable member may be adopted in the bottom 343. The end part of the bottom 343 at the side of the image processing apparatus 100 is bonded with the lower end part of the slide member 342.

FIG. 8(A) illustrates a state of opening the lid section 323, and FIG. 8(B) illustrates a state of closing the lid section 323. When the lid section 323 is in the opened state, the bottom 343 is kept in the staircase shape or the bellows shape, and the inclined angle of the bottom 343 is gentle. If the lid section 323 is in the closed state, the protrusion section 341 contacts with the upper end part of the slide member 342, and the protrusion section 341 downwards presses the slide member 342. In this way, the bottom 343 of which the end part is bonded with the slide member 342 extends, and the inclined plane of the bottom 343 becomes a steeper slope than that in the opened state. In this way, when the inclined plane is changed from the gentle slope to the steep slope, the sheet moves downwards and is energized towards the image processing apparatus 100 to approach the image processing apparatus 100 side. It can be suppressed that the sheet is located at a position that is not reachable for the pickup section 302.

Through the fourth embodiment, the foreign substance is suppressed from being mixed to the inside of the side sheet feed section 300, and it is suppressed that the housed sheet is easily recognized visually by the third party.

Operation Example

Figure 9:
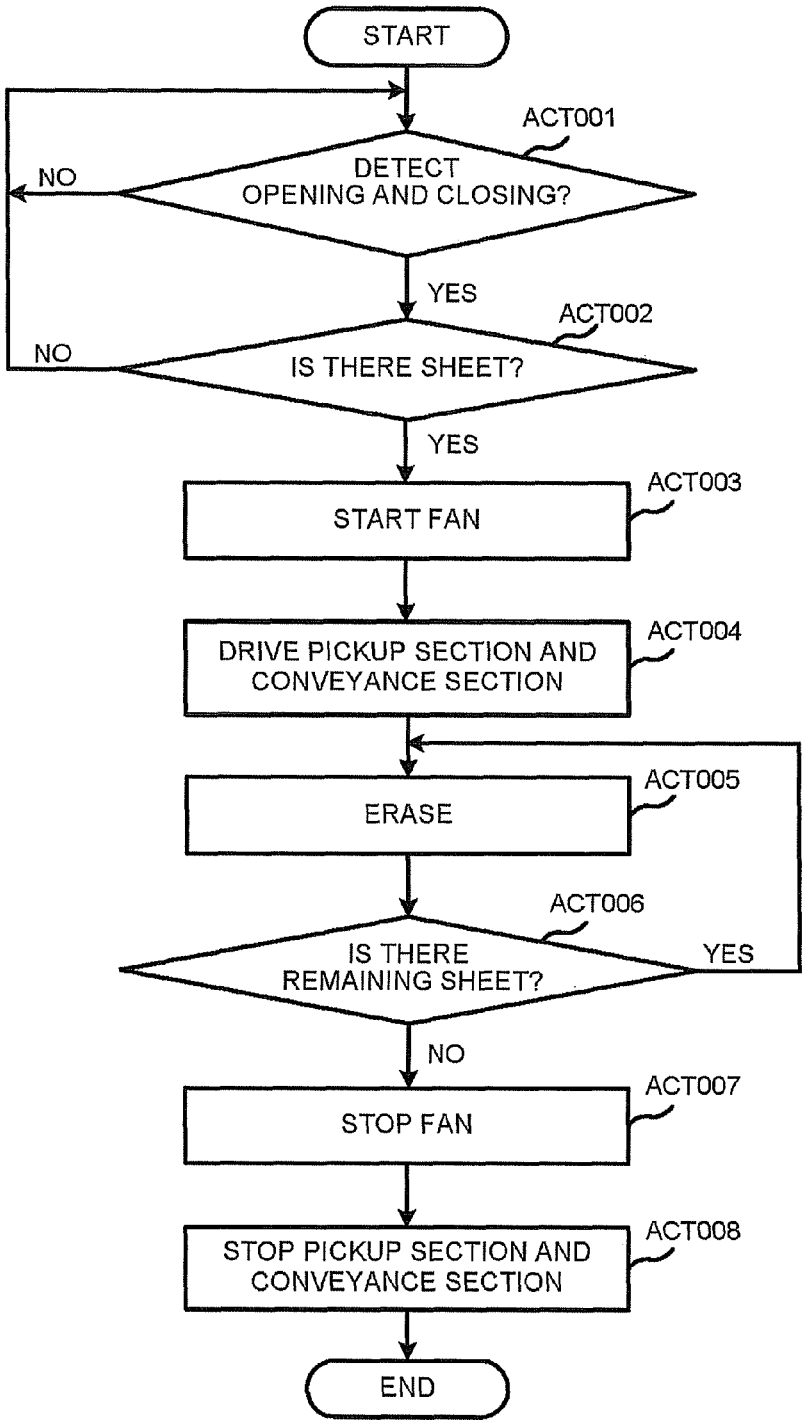
FIG. 9 is a flowchart illustrating an example of operations of the image processing apparatus according to the embodiment.

The operation example in a case of including all the mechanisms described according to each of the foregoing embodiments is described with reference to a flowchart in FIG. 9. The control of the operations shown in FIG. 9 is carried out by the control section 170. In other words, the processor of the image forming control section 110 or the decoloring control section 210 executes the program stored in the storage section to control the operations shown in FIG. 9.

The control section 170 determines whether or not the lid section 323 is switched from the opened state to the closed state through the detection signal from the opening and closing detection switch 324 (ACT 001). If the lid section 323 is switched from the opened state to the closed state (Yes in ACT 001), the control section 170 determines whether or not the sheet is housed in the side sheet feed section 300 on the basis of the detection signal of the sensor 351 (ACT 002). If no sheet is housed (No in ACT 002), the control section 170 returns to the processing in ACT 001.

If the sheet is housed (Yes in ACT 002), the control section 170 controls the fan 310 to operate (ACT 003). The control section 170 enables the pickup section 302 to operate to pick up one sheet and enables the conveyance section 202 to operate to convey the sheet to the decoloring section 212 (ACT 004). The decoloring section 212 carries out a heating decoloring processing of an image on the conveyed sheet (ACT 005). The processed sheet is conveyed to the decolored sheet cassette 213 through the conveyance section 202.

The control section 170 determines whether or not there is a remaining sheet in the side sheet feed section 300 on the basis of the detection signal of the sensor 351 (ACT 006). If there is the remaining sheet (Yes in ACT 006), the control section 170 returns to the processing in ACT 005, and the decoloring processing is carried out on each sheet. If there is no remaining sheet (No in ACT 006), the control section 170 stops the fan 310 (ACT 007), and stops the pickup section 302 and the conveyance section 202 (ACT 008).

Figure 10:
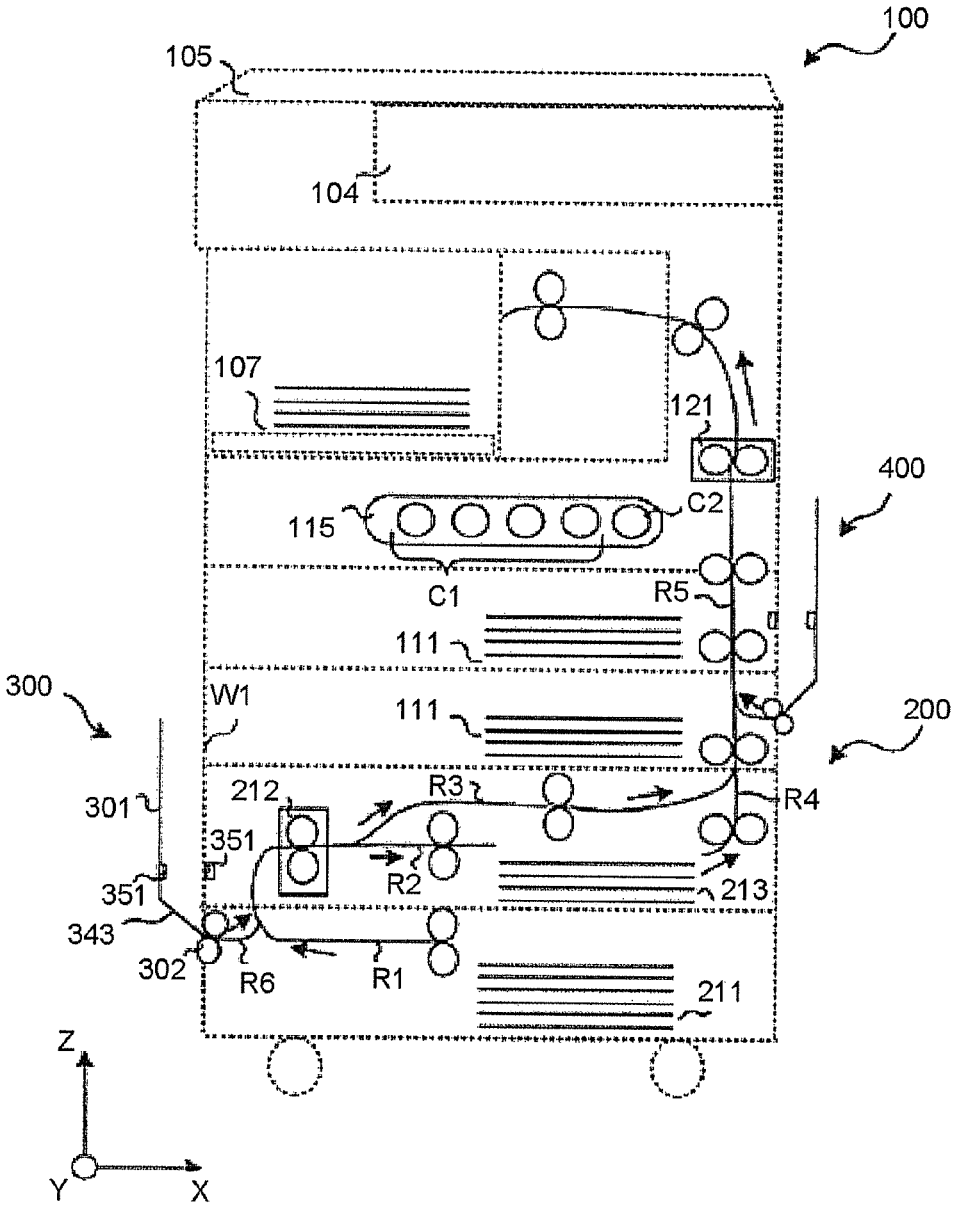
FIG. 10 is a diagram exemplifying a side sheet feed section for supplying a sheet to an image forming section.

In each of the foregoing embodiments, it is described that the side sheet feed section 300 is mounted in the image decoloring apparatus 200. In other words, the side sheet feed section 300 is located at the upstream side of the decoloring section 212 and is described as a part for supplying the sheet to the decoloring section 212. However, the embodiment is not limited to this. As shown in FIG. 10, a side sheet feed section 400 for supplying the sheet to the image forming section 115 may be arranged. By arranging the side sheet feed section 400, the sheet can be set much easily when compared than the normal cassette 111.

In the foregoing embodiment, it is described that the "decoloring processing" refers to erasing the color of the image; however, it may refer to erasing the image. In other words, the image decoloring apparatus recorded in the present embodiment is not limited to the apparatus that erases the color of the image through the heating. For example, the image decoloring apparatus may be an apparatus that erases the color of the image on the sheet through irradiation of light or an apparatus that erases the image formed on a special sheet. Otherwise, the image decoloring apparatus may be an apparatus that removes (erases) the image on the sheet. The image decoloring apparatus may make the image on the sheet invisible to be capable of reusing the sheet.

Further, the "image processing" described in the each of the forgoing embodiments includes a processing of forming the image or/and a processing of erasing the image.

As stated above in detail, according to the embodiment, the sheet can be set in the supply section in a workmanlike manner.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image processing apparatus, comprising:

a container mounted on a side wall of the image processing apparatus and comprising a bottom extending upwards in the vertical direction at a predetermined angle from the side wall for supporting an end of a sheet and a wall member vertically arranged on the bottom and forming a space with the bottom, and configured to house a sheet in the space through an opening formed on the upper side of the container;

a pickup unit located adjacent to the bottom of the container and having a pickup roller and configured to move the pickup roller to the inside of the container if a pickup operation for conveying the sheet to the inside of the image processing apparatus is executed, and keep the pickup roller at a waiting position outside of the space of the container if the pickup operation is not executed; and an air blower located on the side wall and configured to blow air from the inside of the container towards the inside of the image processing apparatus.

2. The image processing apparatus according to claim 1, wherein the air blower starts to blow the air before the pickup roller moves to the inside of the container.

3. The image processing apparatus according to claim 2, wherein the air blower comprises a fan for cooling the inside of the image processing apparatus.

4. The image processing apparatus according to claim 1, further comprising a lip configured to be opened or closed to make the opening of the container in an opened state or in a closed state;

a detector configured to detect opening and closing of the lip; and a controller configured to control operations of the pickup unit on the basis of a detection signal of the detector.

5. The image processing apparatus according to claim 4, further comprising an air blower located on the side wall and configured to blow air from the inside of the container towards the inside of the image processing apparatus.

6. The image processing apparatus according to claim 5, wherein the air blower comprises a fan for cooling the inside of the image processing apparatus.

7. An image processing method, comprising:

housing a sheet to be processed in a space of a container mounted on a side wall of an image processing apparatus through an opening formed on the upper side of the container, the container having a bottom extending upwards in the vertical direction at a predetermined angle from the side wall for supporting an end of the sheet and a wall member vertically arranged on the bottom and forming the space with the bottom;

moving a pickup roller located adjacent to the bottom of the container into the inside of the container if a pickup operation for conveying the sheet to be processed to the inside of the image processing apparatus is executed;

keeping the pickup roller at a waiting position outside of the space of the container if the pickup operation is not executed; and blowing air from the inside of the container towards the inside of the image processing apparatus.

8. The image processing method according to claim 7, wherein blowing air before the pickup operation.

9. The image processing method according to claim 7, wherein blowing air for cooling the inside of the image processing apparatus.

10. The image processing method according to claim 7, further comprising opening or closing a lip to place an upper part of the container in an opened state or a closed state;

detecting opening and closing of the lip; and controlling the pickup operation on the basis of a detection signal of whether the upper part of the container is in an opened state or a closed state.

11. The image processing method according to claim 10, further comprising blowing air from the inside of the container towards the inside of the image processing apparatus.

12. The image processing method according to claim 11, wherein blowing air comprises using fan for cooling the inside of the image processing apparatus.

* * * * *